United States Patent [19]

Donaldson

[11] Patent Number: 4,551,944

[45] Date of Patent: Nov. 12, 1985

[54] DOOR CONTROL APPARATUS

[75] Inventor: George W. Donaldson, Monroeville, Pa.

[73] Assignee: Westinghouse Electric Corp., Pittsburgh, Pa.

[21] Appl. No.: 571,611

[22] Filed: Jan. 17, 1984

[51] Int. Cl.[4] ..... E05F 15/20

[52] U.S. Cl. ..... 49/31; 49/68; 49/262

[58] Field of Search ..... 49/13, 31, 68, 262; 246/182 R, 221, 167 R; 191/57

[56] References Cited

U.S. PATENT DOCUMENTS

| | | | |
|---|---|---|---|
| 3,884,437 | 5/1975 | Linderman | 246/182 R |
| 4,491,917 | 1/1985 | Higgins et al. | 49/13 |
| 4,503,778 | 3/1985 | Wilson | 49/262 |

*Primary Examiner*—Kenneth Downey
*Attorney, Agent, or Firm*—R. G. Brodahl

[57] ABSTRACT

Door control apparatus is provided for opening and closing the passenger doors of a transit vehicle and the cooperating doors of a station, which apparatus includes conductors respectively coupled with a station power supply and the station door motors and extending along the station platform where passengers load and unload relative to the vehicle, such that a shunt connection member carried by the vehicle and coupled with the vehicle door motor is operative to energize the vehicle door motor and the station door motor for operating the passenger doors and the station doors when the vehicle is positioned at the station platform to load and unload passengers in relation to the vehicle.

7 Claims, 4 Drawing Figures

DOOR CONTROL APPARATUS

BACKGROUND OF THE INVENTION

It is known in the prior art, when a vehicle enters a passenger station, to operate the passenger doors in the station in conjunction with the passenger doors of the vehicle stopped in that station. After the vehicle stops in the station, it transmits a signal which tells the station door control apparatus that the vehicle is stopped and aligned with the station doors. A signal is then transmitted to the vehicle door control appratus telling the vehicle to open its doors, and the vehicle in turn transmits a signal requesting the station doors to open. After the predetermined dwell time for the station stop is completed, the vehicle and station doors are commanded to close and the vehicle departs from the station. This operation is described in an article entitled "Atlanta Airport Automated Guideway Transit System" that was published as Preprint 36549 of the ASCE Convention in Altanta, Ga., in October 1979.

It is known in the prior art to control the doors of a transit vehicle after a program stop operation for the vehicle is completed and the vehicle is positioned in the station at zero speed. Upon proper alignment with the station platform, the vehicle door control receiver will detect the presence of a door open signal from the station door antenna. After checking the validity of this signal, the vehicle door control transmitter will send a signal to permit the station passenger doors to open. The vehicle doors open in synchronization with the station doors and further depend upon the provision of a zero speed signal and a brake pressure applied signal. This operation is described in an article entitled "Recent Applications of Microprocessor Technology to People Mover Systems" that was published in the record of the 29th IEEE Vehicle Technology Group Conference at Chicago, Ill., in March 1979.

It is known in the prior art to provide respective power supplies for each of the station passenger doors and the vehicle passenger doors, with separate motors and control logic signal decoding and considerable effort being made to synchronize the opening and closing of both the station and vehicle doors, and to prevent the vehicle doors from opening when the vehicle is not in the station in proper position and at zero speed before the doors can open.

SUMMARY OF THE INVENTION

A door control apparatus for the passenger doors of a transit vehicle and the correlated station doors is coupled with a station power supply and includes conductors extending along the roadway track in the station and vehicle-carried cooperating conduction members, which are positioned relative to the station doors and the desired vehicle stopping position, such that the vehicle doors and the station doors are cooperatively energized from the same wayside power supply to provide the desired operation of those passenger doors. The vehicle door control motor operation requires that a good ground connection including the vehicle body be provided to prevent electrical shocks to the passengers moving through the vehicle and station doors.

DESCRIPTION OF A PREFERRED EMBODIMENT

Figure 1:
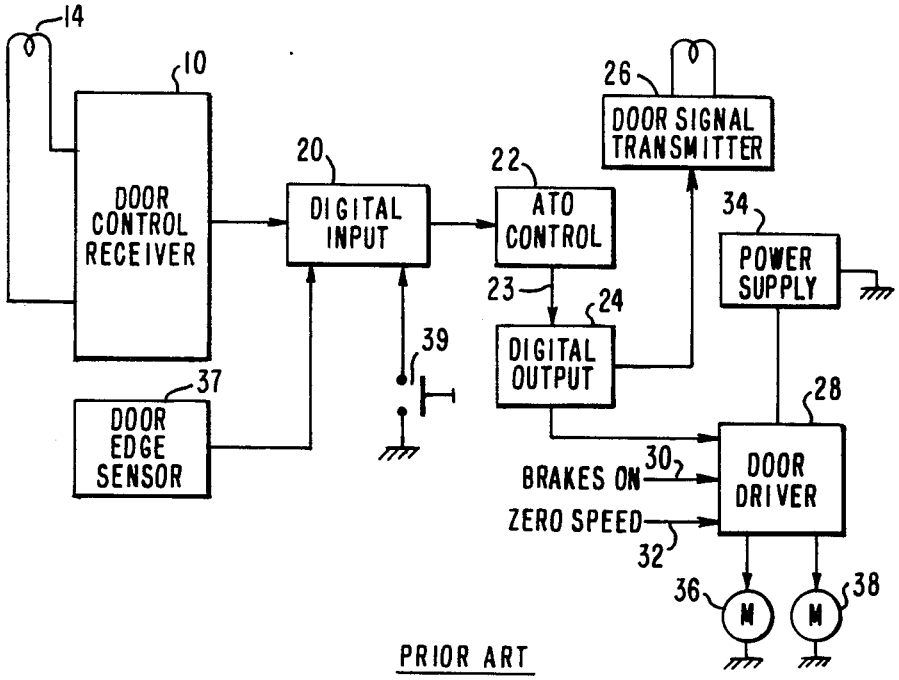
PRIOR ART FIG. 1
FIG. 1 shows a prior art vehicle door control system.

In FIG. 1 there is shown a prior art vehicle door control system including a door control receiver 10 which upon proper alignment with the station platform is responsive to an input door control signal 12 through an antenna 14 when the vehicle is properly positioned in the station. The signal goes through the digital input apparatus 20 to the automatic train operation ATO control 22. After ATO control 22 determines that the program stop operation is completed and the vehicle is properly aligned with the station passenger doors, and the validity of the door control signals is established, a door open signal 23 is supplied through the digital output 24 to activate the door signal transmitter 26 for permitting operation of the station doors and to activate the door driver 28 to open the vehicle doors after a signal 30 indicates the brakes are ON and a signal 32 indicates a zero speed condition for the vehicle. The power supply 34 operates with the door driver 28, for opening the vehicle door leaf ONE by the motor 36 and the vehicle door leaf TWO by the motor 38 synchronized with the opening of the station doors. A door edge sensor 37 can be provided to open the vehicle doors if an obstruction is sensed when closing. An emergency switch 39 can be provided for a passenger to operate manually the vehicle doors when desired.

Figure 2:
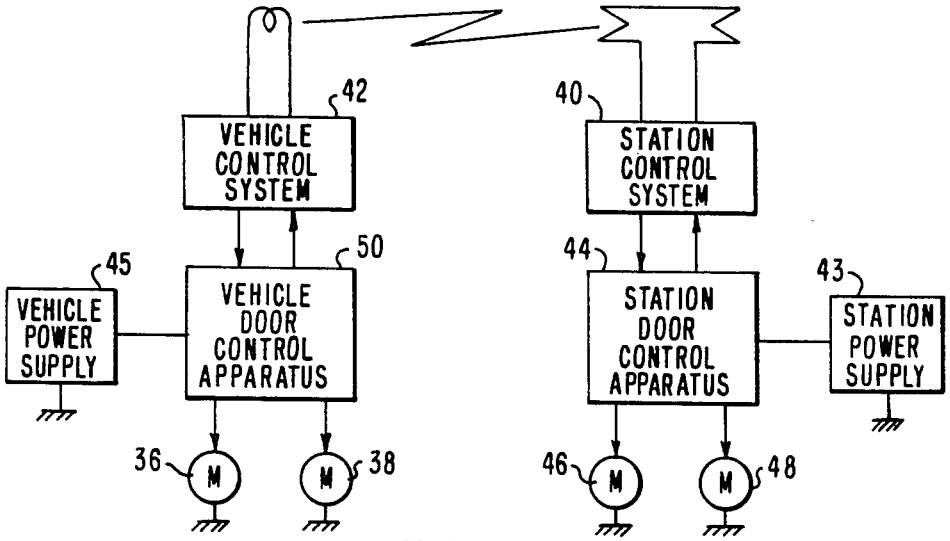
PRIOR ART FIG. 2
FIG. 2 shows a prior art vehicle and station door control signal communication arrangement.

As shown in FIG. 2, the station control system 40 signals the vehicle control system 42 when the vehicle is properly aligned with the station passenger platform and doors. After recognizing the proper door control and data signal, the vehicle control system 42 signals the station control system 40 to open the station doors through operation of the station door control apparatus 44 in conjunction with the station power supply 43 to energize the station door leaf ONE motor 46 and the station door leaf TWO motor 48 for opening the station doors. In synchronism, the vehicle control system 42 operates through the vehicle door control apparatus 50 in conjunction with the vehicle power supply 45 to energize the vehicle door leaf ONE motor 36 and the vehicle door leaf TWO motor 38 for opening the vehicle passenger doors.

Figure 3:
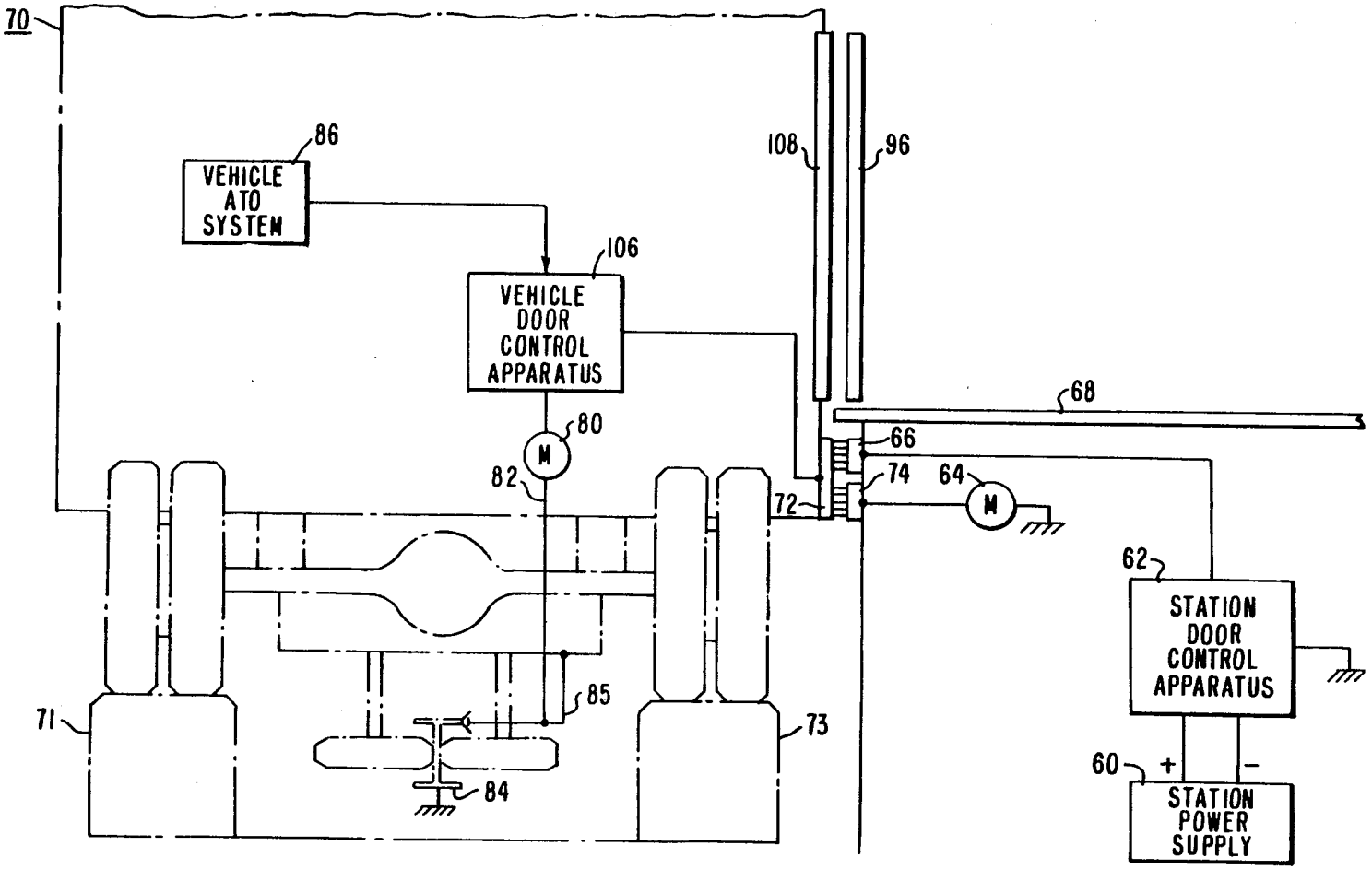
FIG. 3 shows the vehicle and station door control apparatus of the present invention.

In FIG. 3 there is shown the vehicle and station door control apparatus of the present invention. The station power supply 60 is used for both the station and the vehicle door operations and is located on the wayside. The polarity of the power supply 60 is controlled by the logic of the station door control apparatus 62, such that the negative is connected to ground to operate the motor 64 coupled with the station doors to open those doors, and the positive is connected to ground to operate the motor 64 to close the station doors. The station door control apparatus 62 determines the polarity that is applied to the source contact 66 for this purpose. Any desired interlocks, timing and rate control would be established by the station door control apparatus 62. The source contact bar 66 extends along the station platform 68 and for the platform portion over which it is desired to have passenger door operation. Beyond the length of this contact 66 the source voltage for operating the door motors would not be available. Carried by the vehicle 70, which travels along a roadway track such as described in U.S. Pat. No. 4,168,770 of W. R. Segar et al., is a cooperating conduction member 72 such as a metallic brush that completes the electrical circuit for the current of door motor 64 through a return contact 74 coupled with one terminal of the motor 64. The other terminal of motor 64 is connected to ground. The length of the return contact 74 is about one-half the length of the source contact 66. A conduction member 72 is located in the middle of each door leaf position on the vehicle and each of the return contacts 74 extends beyond the end of the mating wayside door for a distance equal to one-half of the width of a vehicle door leaf. This arrangement permits all door leaves to operate until the vehicle is stopped with less than one door leaf matching. Under this condition, only the mating vehicle and station door leaves will open.

The vehicle door control apparatus 106 is connected to the conduction member 72 to receive current for the vehicle door motor 80 through the station door control apparatus from the station power supply 60, such that both the vehicle door motor 80 and the station door motor 64 receive power only when the vehicle is properly stopped at a specific desired platform location in the station. The vehicle door motor 80 and the station door motor 64 will operate synchronously because of the common power supply 60 and control operation by the station door control apparatus 62. The vehicle door motor will not operate without the ground connection 82 coupled with the grounded guide beam 84. Vehicle 70 is stopped and aligned with the station doors.

Figure 4:
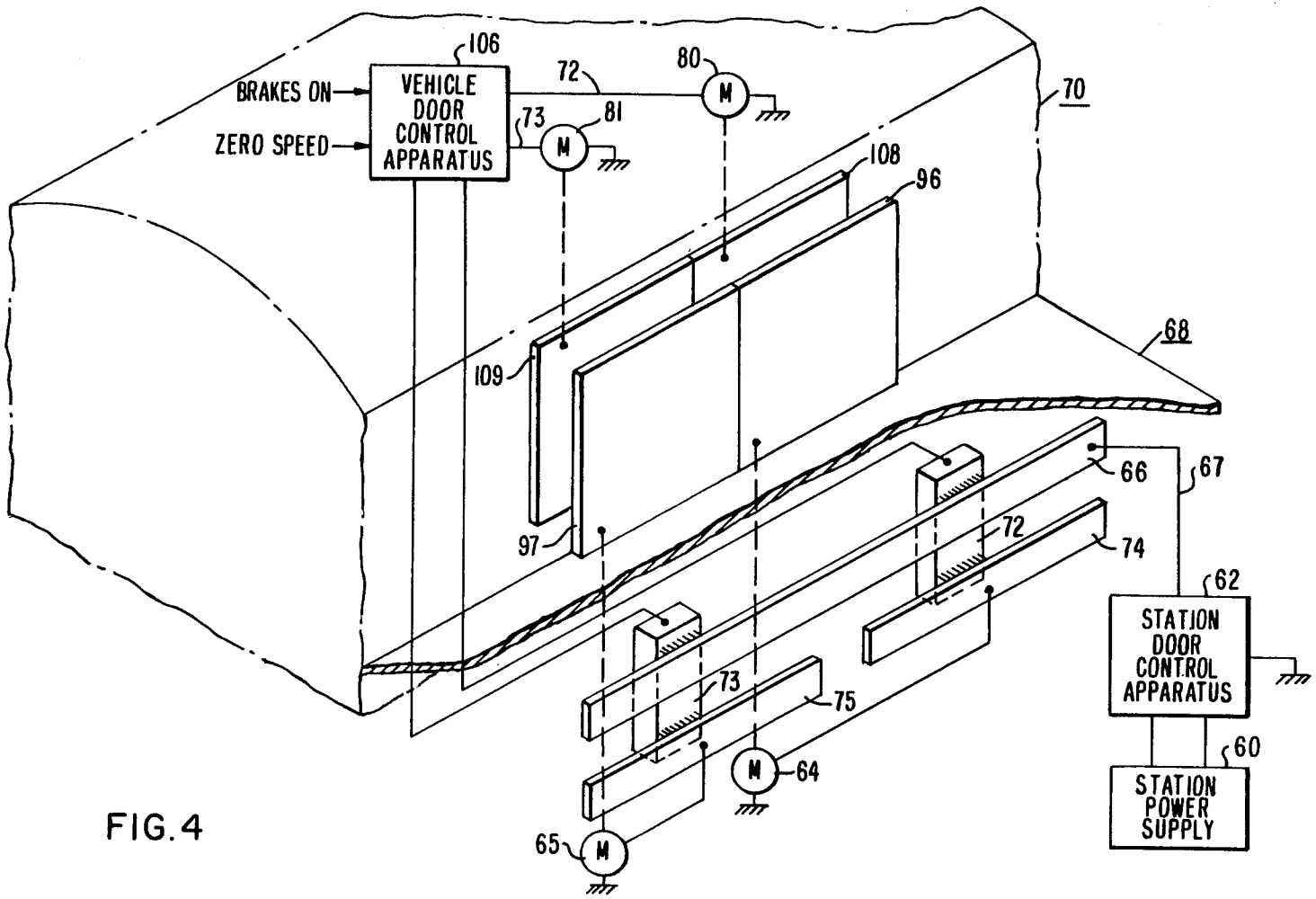
FIG. 4 shows the control conductors and coupling member arrangement of the present invention.

In FIG. 4 there is shown the door motor control contact and conduction member arrangement of the present invention. The vehicle 70 is shown stopped in position along the station platform 68 for loading and unloading passengers. The vehicle doors 108 and 109 cooperate with the respective station doors 96 and 97. The station power supply 60 operates through the station door control apparatus 62 for determining the operation of the station motor 64 coupled with the station door 96 and the station motor 65 coupled with the station door 97. The connection 67 from the station door control apparatus 62 energizes the source contact 66. The return contact 74 is connected through the station motor 64 to ground. The return contact 75 is connected through the station motor 65 to ground. The conduction member 72 is connected through the vehicle door control apparatus 106 to energize the vehicle door motor 80 to ground for the vehicle door 108, and the conduction member 73 is connected through the vehicle door control apparatus 106 to energize the door motor 81 to ground for the vehicle door 109.

A passenger protection feature of the present invention is that the vehicle door motors 80 and 81 have to be connected to ground potential before the vehicle doors 108 and 109 will open to assure that the vehicle 70 is properly grounded. This prevents a passenger injury caused by some high potential being applied to the car body due to a fault condition and the vehicle doors then open to permit a passenger being electrically shocked by this undesired high potential condition. The connection of the door motors 80 and 81 to ground 84 as shown in FIG. 3 in conjunction with the vehicle 70 ground connection 85 assures that the vehicle 70 is properly grounded and safe before the vehicle doors 108 and 109 can open.

The vehicle passenger doors 108 and 109, as well as the station passenger doors 96 and 97, are bipartite doors having a first section leaf 108 that moves in one direction and a cooperating second section leaf 109 that moves in the opposite direction. The provision of the two conduction members 72 and 73 operating with the respective return contacts 74 and 75 allow separate control of a selected one of the door sections when desired, such as when the vehicle stopped a short distance past the normal passenger loading position and only the one door section that was aligned with the desired position was suitable for loading passengers.

By having the power supply 60 for operating both the vehicle doors 108 and 109 and the station doors 96 and 97 located at the wayside station, there is less likelihood for the vehicle doors 108 and 109 to open when not desired. An additional safety feature is provided by assuring that the vehicle 70 is properly grounded through a ground connection 85 and including the door motor circuit in cooperation with this ground connection 85 for the vehicle 70.

The typical station power supply 60 could have a voltage of 24 or 36 volts DC. The vehicle door motors 80 and 81 should be similar to the station door motors 64 and 65 such that the respective door movements would be similar.

If desired, the source contact 66 and the associated return contacts 74 and 75 could be located at the side of one of the vehicle tracks 71 or 73 if it is desired to isolate them from the passenger platform 68. The cooperating conduction members 72 and 73 would then be operative below the vehicle with the source contact 66 and the respective return contacts 74 and 75 as previously described.

I claim:

1. In apparatus for controlling at least one passenger door of a transit vehicle movable along a roadway track in relation to at least one passenger door of a station, with the station including a passenger platform and a power supply, the combination of:

first motor means coupled to move the one station door for opening and closing said station door, second motor means coupled to move the one vehicle door for opening and closing said vehicle door, first conductor means positioned along said platform and coupled with the power supply, second conductor means positioned along said first conductor means and coupled with the first motor means, and connection means coupled with the second motor means and carried by said vehicle for providing an electrical connection between the first and second conductor means and energizing the first and second motor means for operating said station door and said vehicle door.

2. The apparatus of claim 1, with the first and second conductor means being positioned in a predetermined location at said platform where passengers load and unload in relation to the vehicle.

3. The apparatus of claim 1, with the second conductor means having a length determined in accordance with the movement of the one vehicle door by said second motor means.

4. The apparatus of claim 1, including:

third motor means coupled to move a second station door for opening and closing said second station door, fourth motor means coupled to move a second vehicle door for opening and closing said second vehicle door, third conductor means positioned along the first conductor means and coupled with the third motor means, and second connection means coupled with the fourth motor means and carried by the vehicle for providing an electrical connection between the first and third conductor means and energizing the third and fourth motor means for operating the second station door and the second vehicle door.

5. The apparatus of claim 4, with the second conductor means being positioned in relation to the one vehicle door when the vehicle is in said station and adjacent to said platform, and with the third conductor means being positioned in relation to the second vehicle door when the vehicle is in said station and adjacent to said platform.

6. The apparatus of claim 1, with the third conductor means having a length determined in accordance with the movement of the second vehicle door by said fourth motor means.

7. The apparatus of claim 4, with the first conductor means having a length at least equal to the combined lengths of the second and third conductor means.

* * * * *